US007980068B2

(12) United States Patent
Rinaldi

(10) Patent No.: US 7,980,068 B2
(45) Date of Patent: Jul. 19, 2011

(54) WOVEN METAL FIBER PARTICULATE FILTER

(75) Inventor: Fabrizio C Rinaldi, Jackson, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 776 days.

(21) Appl. No.: 11/605,513

(22) Filed: Nov. 28, 2006

(65) Prior Publication Data

US 2007/0151231 A1 Jul. 5, 2007

Related U.S. Application Data

(60) Provisional application No. 60/754,999, filed on Dec. 29, 2005.

(51) Int. Cl.
*F01N 3/00* (2006.01)

(52) U.S. Cl. ..... 60/297; 60/295; 60/303; 60/311

(58) Field of Classification Search ..... 60/297, 60/311, 295, 303

See application file for complete search history.

(56) References Cited

U.S. PATENT DOCUMENTS

| | | | | | |
|---|---|---|---|---|---|
| 2,975,586 | A * | 3/1961 | Bray | 60/284 |
| 3,105,752 | A * | 10/1963 | Bruce | 55/302 |
| 3,857,688 | A * | 12/1974 | Wisnewski | 55/483 |
| 4,149,862 | A * | 4/1979 | Sewell, Sr. | 96/131 |
| 4,567,725 | A * | 2/1986 | Shinzawa et al. | 60/274 |
| 5,212,948 | A * | 5/1993 | Gillingham et al. | 60/288 |
| 5,238,474 | A * | 8/1993 | Kahlbaugh et al. | 55/320 |
| 5,293,742 | A * | 3/1994 | Gillingham et al. | 60/288 |
| 5,682,740 | A | 11/1997 | Kawamura | |
| 5,776,419 | A * | 7/1998 | Ihara et al. | 422/177 |
| 6,857,525 | B2 * | 2/2005 | Parent | 210/457 |
| 6,942,708 | B2 * | 9/2005 | Peter et al. | 55/282.3 |
| 7,153,345 | B2 * | 12/2006 | Li et al. | 95/137 |
| 7,294,162 | B2 * | 11/2007 | Anderson et al. | 55/498 |

(Continued)

FOREIGN PATENT DOCUMENTS

| | | | |
|---|---|---|---|
| CN | 2432454 | | 5/2001 |
| JP | 07-008727 | * | 1/1995 |

OTHER PUBLICATIONS

The Behavior of Metal DPFs at Low Temperatures in Conjunction with a Cerium Based Additive, K. Pattas, et al., SAE 980543, Feb. 23-26, 1998.

(Continued)

*Primary Examiner* — Thomas E Denion
*Assistant Examiner* — Diem Tran
(74) *Attorney, Agent, or Firm* — Harness, Dickey & Pierce, P.L.C.

(57) ABSTRACT

A passive particulate filter assembly for filtering exhaust. The assembly includes a housing unit defining a filtering chamber having an inlet port and an outlet port. A cylindrical inner core member is disposed in the filtering chamber and is surrounded by a pleated cylindrical filter pack having first and second opposite ends. An end cap couples with the first end of the filter pack and is configured to prevent exhaust flow there through. An end plate is coupled to the second end of the filter pack and is configured to secure the filter pack to the housing unit. The filter pack comprises a woven metal fiber medium preferably manufactured from stainless steel or a nickel-chromium-iron alloy having a porosity of between about 2 to about 15 μm.

16 Claims, 5 Drawing Sheets

U.S. PATENT DOCUMENTS

| | | | |
|---|---|---|---|
| 2004/0131511 | A1 | 7/2004 | Marrecau et al. |
| 2004/0148916 | A1 | 8/2004 | Merkel |
| 2004/0216451 | A1 | 11/2004 | LaBarge et al. |
| 2004/0226443 | A1 | 11/2004 | Gillingham et al. |

OTHER PUBLICATIONS

A Review of Diesel Particulate Filter Technologies, Magdi K. Khair, SAE 2003-01-2303, Jun. 23-25, 2003.

* cited by examiner

WOVEN METAL FIBER PARTICULATE FILTER

RELATED APPLICATION

This application claims priority from U.S. Provisional Patent Application No. 60/754,999, filed Dec. 29, 2005.

FIELD

The present disclosure relates to the particulate filtering of engine exhaust gases.

BACKGROUND

The statements in this section merely provide background information related to the present disclosure and may not constitute prior art.

In the automotive industry, environmental concerns require a continued reduction in the amount of particulates, including soot particulates and non-combusted particulates, discharged from engines. Various attempts have been made to decrease these particulate emissions from the use of fuels, such as diesel. Typical catalytic converters often do not work well with some engines, since the temperatures within them are too low to effectively burn carbon, oil, and unburned fuel particles. Currently, research has been performed using exhaust gas filtering systems having a particulate filter inserted in an exhaust pipe of the engine to collect the particulates. In general, the particulate filter is made of a porous ceramic body, which defines a plurality of exhaust gas passages therein. When exhaust gas passes through porous walls of the particulate filter, which define the exhaust gas passages, the particulates are adsorbed and collected by the porous walls of the particulate filter.

When the collected particulates are accumulated in the particulate filter, pressure loss is increased, and the engine performance is deteriorated. Thus, the collected particulates need to be combusted and removed from the particulate filter to regenerate the particulate filter at appropriate timing. The regeneration of the particulate filter is performed by increasing the temperature of the particulate filter through a heating means, such as a burner or a heater or through supply of hot exhaust gas to the particulate filter in post fuel injection.

In view of the above, there remains a demand for a passive exhaust filter system that can successfully remove particulate matter. It is also desirable that the filter system be regenerable and reliable over long periods of time without maintenance.

SUMMARY

The present disclosure provides a passive particulate filter assembly for filtering exhaust. In various embodiments, the assembly includes a housing unit defining a filtering chamber having an inlet port and an outlet port. A cylindrical inner core member is disposed in the filtering chamber and is surrounded by a pleated cylindrical filter pack having first and second opposite ends. An end cap couples the first end of the filter pack and is configured to prevent exhaust flow there through. An end plate is coupled to the second end of the filter pack and is configured to secure the filter pack to the housing unit. The filter pack comprises a woven metal fiber medium preferably manufactured from stainless steel or a nickel-chromium-iron alloy having an average porosity of between about 2 to about 15 μm.

In other embodiments, the present disclosure provides a passive particulate filter assembly including a housing unit defining a filtering chamber having an inlet port and an outlet port. A perforated cylindrical inner core member is disposed within the filtering chamber. A pleated cylindrical filter pack having a dual layer woven sintered metal fiber medium surrounds the inner core member and has first and second opposite ends. The innermost layer of the filter pack has an average porosity of between about 2 to about 7 μm and the outermost layer of the filter pack has an average porosity of between about 7 to about 15 μm. An end cap is coupled to the first end of the filter pack and configured to prevent exhaust flow there through. A flanged end plate is coupled to the second end of the filter pack and is configured to secure the filter pack to the housing unit. In various embodiments, the filter assembly is configured such that the exhaust travels from the inlet port into the filtering chamber and passes inwardly through the dual layer filter pack to an interior of the inner core member and exits through the outlet port.

In still other embodiments, the present disclosure provides an exhaust gas filtering system for a diesel engine. The system includes a passive diesel particulate filter assembly including a housing unit defining a filtering chamber having a cylindrical inner core member surrounded by a dual layer woven sintered metal fiber medium. The innermost layer of the filter pack has an average porosity of between about 2 to about 7 μm and the outermost layer of the filter pack has an average porosity of between about 7 to about 15 μm. The system further includes a secondary injection assembly coupled to the housing unit and configured to selectively heat the diesel exhaust to a temperature suitable for regeneration of the passive diesel particulate filter.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
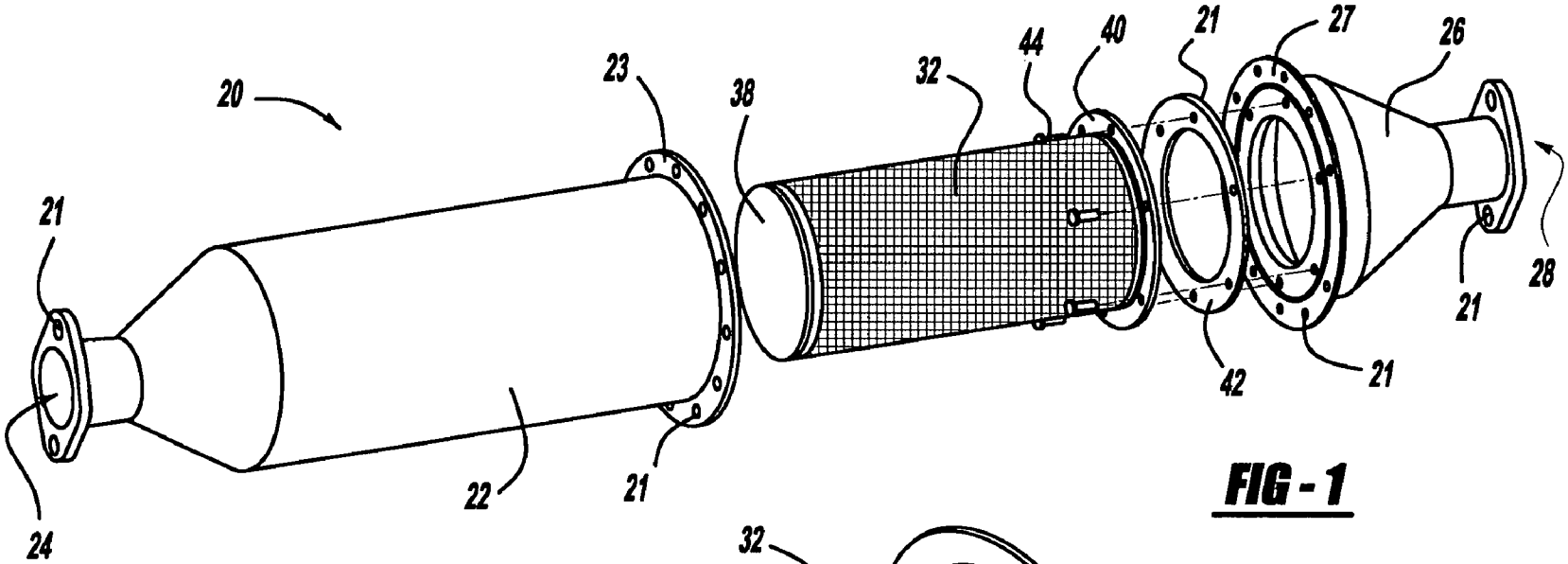
FIG. 1 illustrates an exploded perspective view of a passive particulate filter system for exhaust according to the present disclosure.

The following description is merely exemplary in nature and is not intended to limit the present disclosure, application, or uses. It should be understood that throughout the drawings, corresponding reference numerals indicate like or corresponding parts and features.

FIG. 1 illustrates an exploded perspective view of an exemplary passive particulate filter assembly according to the teachings of the present disclosure and is referenced by the numeral 20. The filter assembly 20 is primarily for removing particulate matter from the exhaust gas of, for example, a diesel engine and is preferably cylindrical in configuration for ease of manufacture, use, and maintenance. Since the filter assembly 20 is passive, there is no need to provide a complicated and expensive power supply and connections within the filter itself. In various embodiments, a secondary injection system is provided to regenerate the filter and is described in more detail below.

As shown, the assembly includes a housing unit that defines a filtering chamber and includes an inlet housing 22 having an inlet port 24 and coupled to an outlet housing 26 having an outlet port 28. As further shown in FIGS. 2 and 3, the assembly 20 further includes a cylindrical inner core member 30 that is disposed within the filtering chamber and surrounded by a pleated cylindrical filter pack 32 having first and second opposite ends 34, 36. An end cap 38 is coupled to the first end 34 of the filter pack 32 and configured to prevent exhaust flow there through. An end plate 40 is coupled to the second end 36 of the filter pack 32 near the outlet 28 and is configured to secure the filter pack 32 to the outlet housing portion 26 of the housing unit. The end plate 40 is typically coupled and/or mechanically secured to the outlet housing 26 and separated with an appropriate gasket 42 made of a high temperature resistant material. The inlet and outlet housings 22, 24 may include appropriate apertures 21 and flanges 23, 27 that can be coupled with screws 44 or other mechanical means as is known in the art. In various embodiments, the assembly further includes one or more welded straps 46, such as 22-24 gauge stainless steel or another corrosion resistant high strength material, that is circumferentially disposed about the filter pack 32 to secure the filter pack 32 to the inner core member 30.

Figure 2:
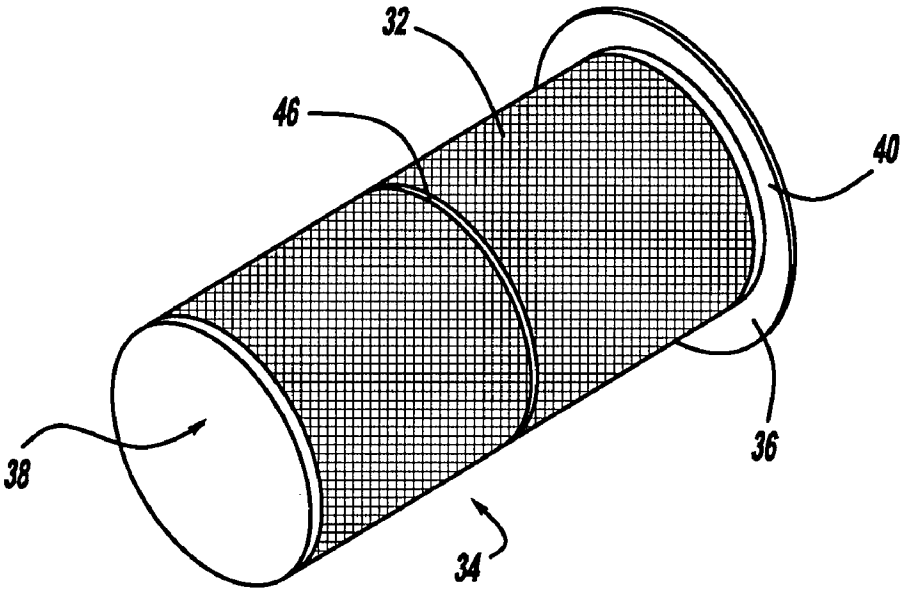
FIG. 2 illustrates a perspective view of a filter assembly.
Figure 3:
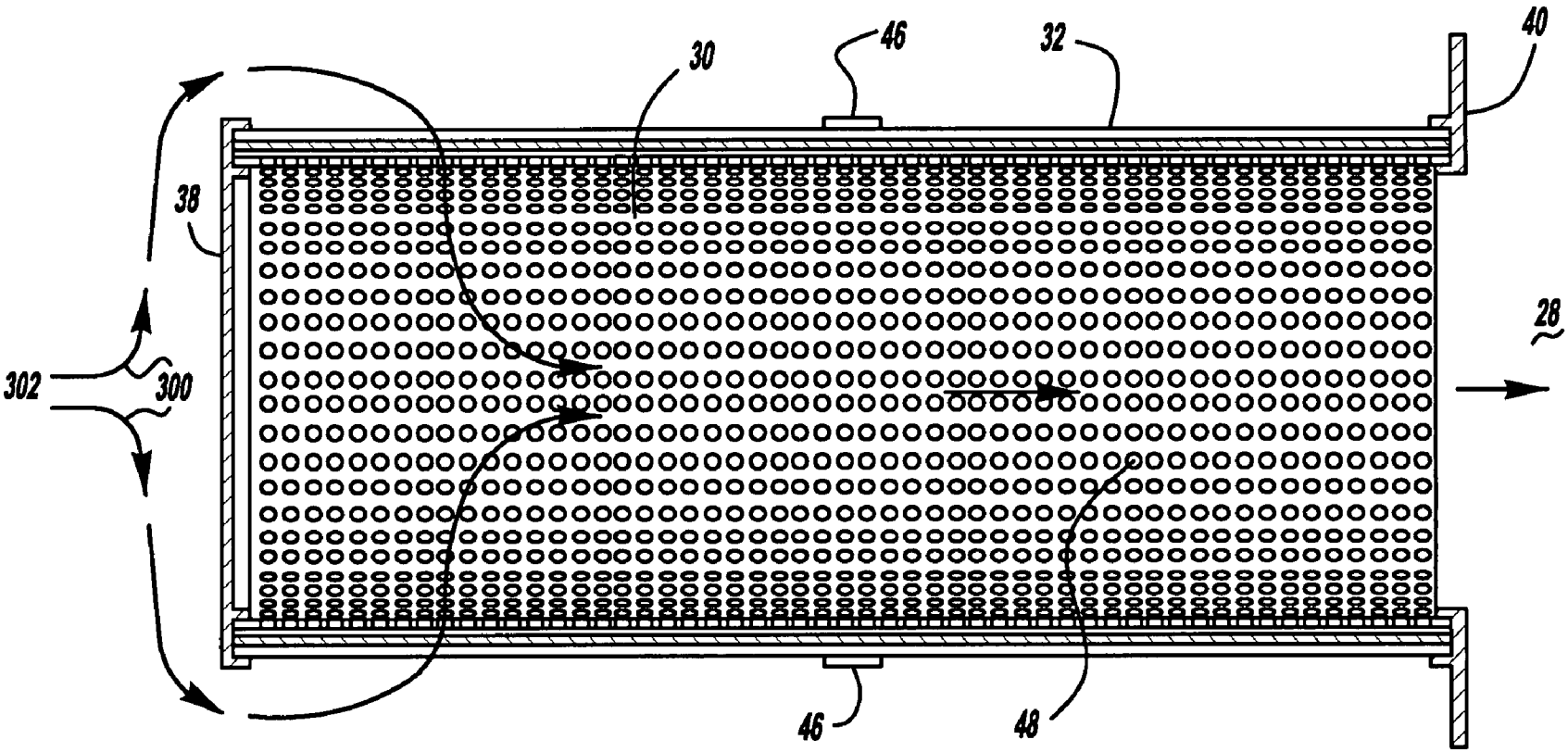
FIG. 3 is a cross-sectional view of FIG. 2 and illustrates the inner core member in addition to the end cap and end plate.

FIG. 3 illustrates a cross-sectional view of FIG. 2 and shows a perspective view of the inner core member 30 in addition to the filter pack 32, end cap 38, and the end plate 40. As shown, an exemplary exhaust gas air flow path 300 is defined as traveling from an inlet area 302 of the housing into the filtering chamber. The air typically flows around the end cap 38 and passes inwardly through the filter pack 32 and through numerous perforations 48 of the inner core member 30 to an interior region of the core 30 and exits through the outlet port 28.

Figure 4:
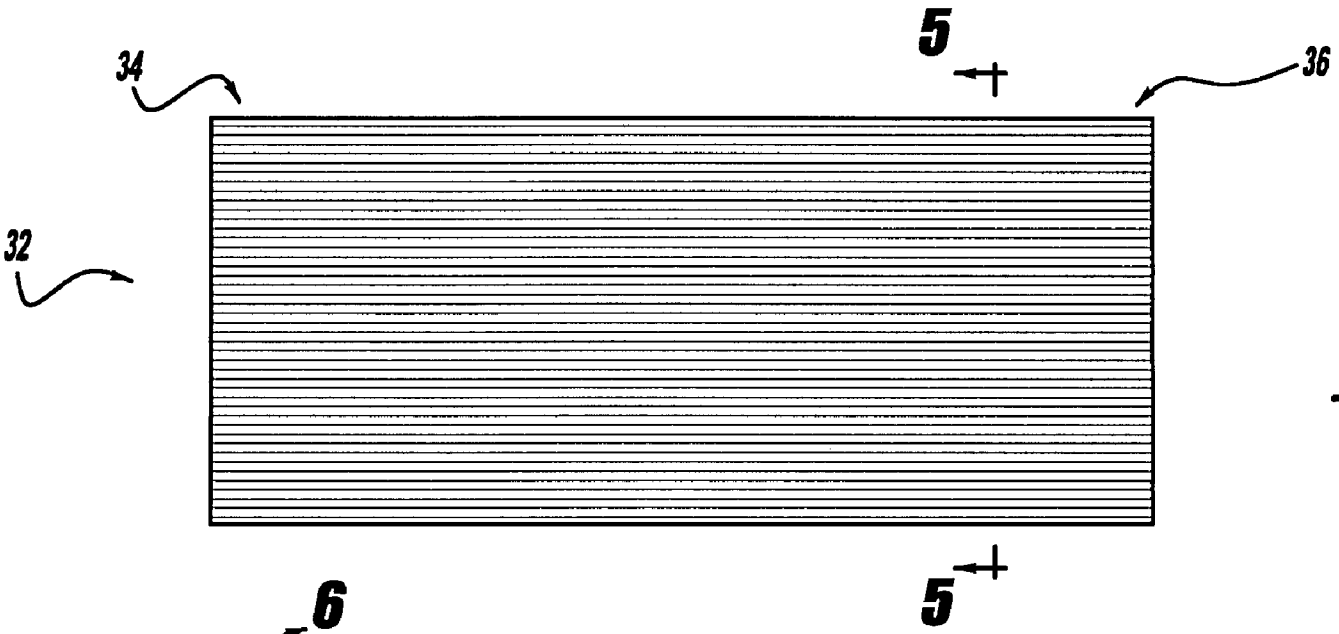
FIG. 4 is a side view of a pleated filter pack.
Figure 5:
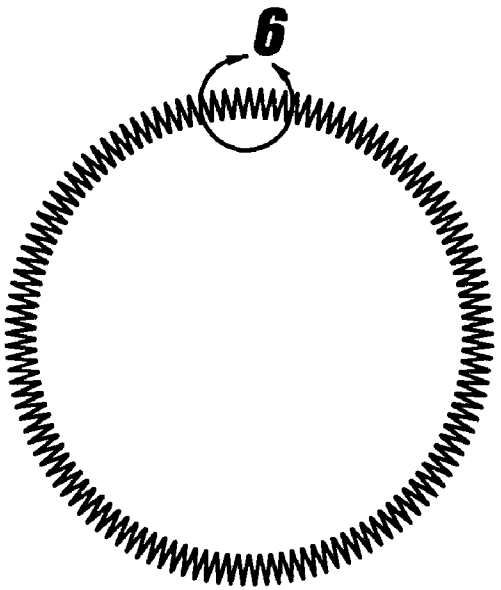
FIG. 5 is a cross-sectional view of FIG. 4.

FIG. 4 is a side plan view of a pleated filter pack 32 and FIG. 5 is a cross-sectional view of FIG. 4 taken along the reference line 5-5. The filter pack 32 of the present invention comprises a woven metal or alloy fiber medium. In various embodiments, the metal fibers can be sintered, non-sintered, or can include a mixture of sintered and non-sintered fibers. One non-limiting example of such a porous woven material includes DYNAPORE®, commercially available from Martin Kurz & Co., Inc. of New York. Preferably, the fibers are manufactured of a material such as nickel-chromium-iron alloy, for example Iconel®, or stainless steel, including for example, 304, 306, 310, and 316 alloys. The woven medium preferably has an average porosity of between about 2 to about 15 μm. In various embodiments, the woven medium comprises a dual layer laminate material with an exterior layer having an exterior porosity and an interior layer having an interior porosity different than the exterior porosity. For example, the outermost layer may have an average porosity of between about 7 to about 15 μm, and the innermost layer may have an average porosity of between about 2 to about 7 μm. It should be understood that this embodiment includes numerous combinations of porosity depending on the design of the filter and the size of the engine with which it will be used. Non-limiting presently preferred combinations include an outer/inner layer average porosity ratio of 8/3.5, 15/3, and 15/8 μm. The dual layer medium may also comprise two layers of a woven material having the same or similar average porosity if so desired. Exemplary soot loading capabilities of the particulate filter assembly 20 of present disclosure typically ranges from about 0.5 g/liter to about 4 g/liter of engine displacement volume and will vary based on the design parameters and desired efficiency.

In various embodiments, the surface area of the pleated filter pack 32 is between about 2.5 to about 8 times the engine displacement volume, preferably from about 4 to about 8 times the engine displacement volume. For example, a six liter engine may have a filter assembly having a total surface area of between about 15 to about 48 $ft^2$, and more preferably between about 24 to about 48 $ft^2$. The surface area may also be dependent upon the desired filtration efficiency, which may vary according to the present teachings from as low as about 20% up to 100% efficiency.

Figure 6:
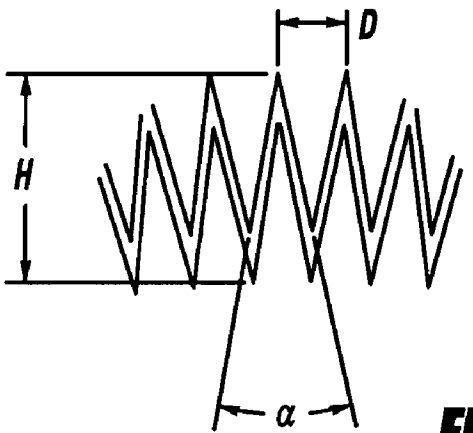
FIG. 6 is a partial magnified view of FIG. 5.

FIG. 6 is a partial magnified view of FIG. 5 and illustrates the pleated arrangement of the woven medium. In various embodiments, the filter pack is configured having at least about 150 pleats, and may include about 175 pleats, and even greater than about 200 pleats, depending upon the size and configuration of the filter assembly 20 and engine. The distance D between the pleats will depend upon the height H of the pleats and the desired angle $\alpha$. It is preferred to have a pleat pack geometry that maximizes the peak-to-peak distance D. In various presently preferred arrangements, the pleated filter pack 32 has about 170 pleats at a height of about 0.5 inches with an angle $\alpha$ of about 22 degrees.

Figure 8:
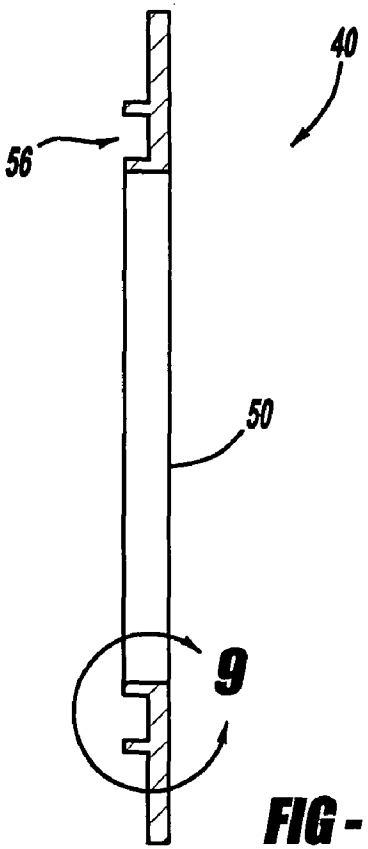
FIG. 8 is a cross-sectional view of FIG. 7.
Figure 9:
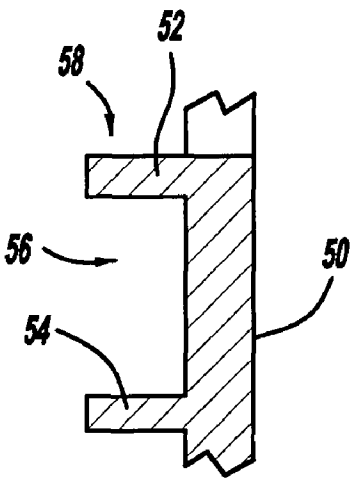
FIG. 9 is a partial magnified view of FIG. 8.
Figure 7:
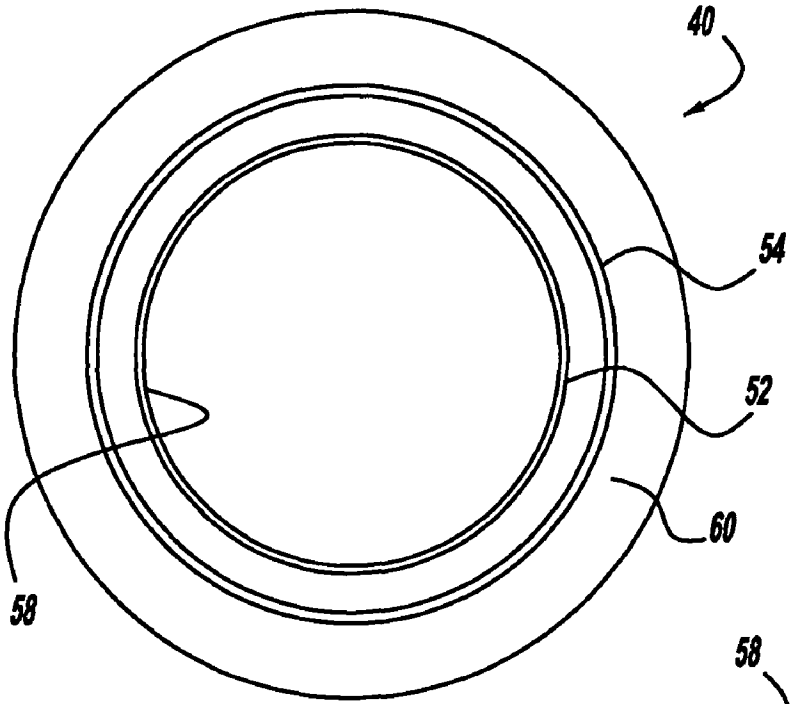
FIG. 7 is a plan view of a flanged end plate.

FIG. 7 illustrates a plan view of a flanged end plate 40 according to the present teachings. FIG. 8 is a cross-sectional view of FIG. 7, and FIG. 9 is a partial magnified view of FIG. 8. The end plate 40 preferably includes a base portion 50 with inner and outer upstanding walls 52, 54 configured to form an opening 56 that couples with and secures the second end 34 of the filter pack 32. The inner upstanding wall 52 defines an aperture 58 allowing for the filtered exhaust gas to flow through to the outlet port. The outer edge of the base 50 defines a flange 60 configured to secure the end plate 40 to the outlet housing 26. The flange 60 may be provided with appropriate apertures (not shown) to allow for the mechanical fastening of the end plate 40 with the housing 26.

Figure 11:
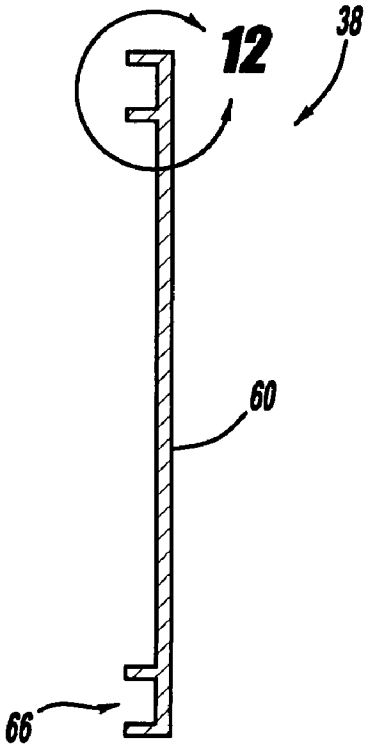
FIG. 11 is a cross-sectional view of FIG. 10.
Figure 12:
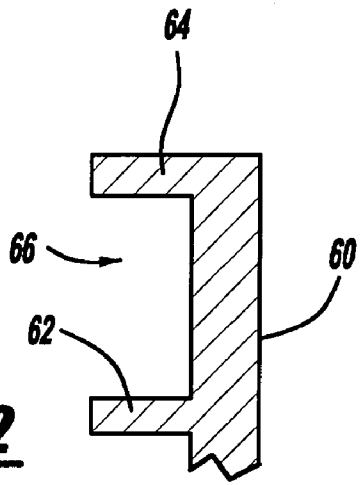
FIG. 12 is a partial magnified view of FIG. 11.
Figure 10:
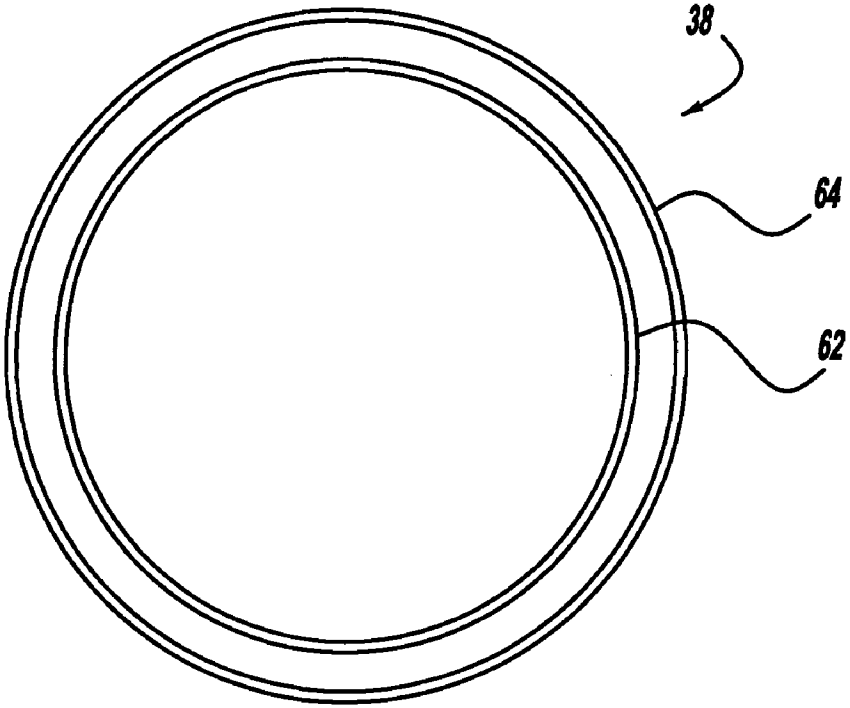
FIG. 10 is a plan view of an end cap.

FIG. 10 illustrates a plan view of an end cap 38 according to the present teachings. FIG. 11 is a cross-sectional view of FIG. 10, and FIG. 12 is a partial magnified view of FIG. 11. The end cap 38 preferably includes a base portion 60 configured to prevent the flow of exhaust there through. The base portion 60 includes inner and outer upstanding walls 62, 64 that define an opening 66 that couples with and secures the first end 34 of the filter pack 32. Once assembled, in various embodiments, the inner core member 30 may be secured between the inner upstanding walls 52, 62 of the end plate 40 and end cap 38, respectively, as best illustrated in FIG. 3. In preferred embodiments, the end cap 38 and end plate 40 are manufactured of stainless steel or an equivalent high strength non-corrosive material.

In various embodiments, the particulate filter assembly of the present teachings is regenerated by a secondary injection means in order to combust the accumulated particulate matter that is trapped within the filter pack. Accordingly, each of the components of the filter assembly 20 is highly resistant to high temperatures. One common approach for regeneration is to heat the incoming exhaust to a temperature suitable for burning and combusting the accumulated particulate matter.

Typically, at the time of injecting fuel into the corresponding combustion chamber from the fuel injection valve, post fuel injection or retardation of fuel injection timing is performed, or alternatively the degree of opening the throttle valve is reduced in comparison to the normal degree of opening the throttle valve that is set for a normal operating period of the exhaust filtering system. In this way, the temperature of the incoming exhaust is increased as a portion of the combustion energy is converted into heat energy rather than being converted in rotational drive force due to, for example, a delay in ignition timing. Thus, exhaust gas of a higher temperature is introduced. Similarly, when the degree of opening of the throttle valve is reduced in comparison to the normal degree of opening of the throttle valve, the flow rate of intake air is reduced, and the thermal capacity of the gas supplied into the corresponding combustion chamber of the engine is reduced and the exhaust gas temperature is increased. It should also be noted that a plurality of regenerating means can be provided, and an appropriate one of the regenerating means can be used based on the operating state of the engine. Additionally, a burner or heater can also be used in place of, or in addition to, the regeneration means. The unique filter pack assembly of the present disclosure is configured to operate having a regeneration fuel penalty of less than about 3%.

There are many methods known in the art that can be used to determine the amount of collected particulates in the filter pack and when regeneration is necessary. One common way to determine the state of charging of the particulate filter is to monitor the back pressure in the exhaust gas system. Typical means may include the use of a differential pressure sensor to determine the backpressure of the filter assembly. A differential pressure sensor measures the pressure difference between an upstream side of the filter assembly and a downstream side of the filter assembly. Typically a signal is sent to a controller for example, an engine control unit (ECU) that controls an exhaust gas recirculation (EGR) valve. Although the back pressure itself does not always represent a suitable criterion for the specific charging state, since any holes present in a layer of soot may well in fact result in a relatively low back pressure falsely indicating too low a charging state, additional certainty in determining the charging state can nevertheless be provided by monitoring the back pressure.

While temperature alone may not represent a suitable criterion for effective secondary injection of fuel for regeneration purposes, it should be understood that secondary injection or after-injection of fuel in each instance serves the purpose of raising the exhaust gas temperature by means of an exothermal reaction that takes place within a specific exhaust temperature. Thus, an exhaust gas temperature sensor and an air/fuel ratio sensor may be arranged at the outlet of the filter assembly to serve as further sensing means to provide data to a controller for determining the proper regeneration times. Alternatively, provisions can be made such that the time between regenerations does not exceed a threshold value. Similarly, reactivation of the regeneration times may be based upon predetermined factors depending upon the use of the engine.

What is claimed is:

1. A passive particulate filter assembly comprising:

a housing unit defining a filtering chamber having an inlet port and an outlet port;

a cylindrical inner core member disposed in the filtering chamber;

a pleated cylindrical filter pack having first and second opposite ends and surrounding the inner core member;

an end cap coupled to the first end of the filter pack and configured to prevent exhaust flow there through; and an end plate coupled to the second end of the filter pack and configured to secure the filter pack to the housing unit;

wherein the filter pack comprises a woven nickel-chromium-iron alloy fiber dual layer laminate having an exterior layer superposed with an interior layer.

2. A filter assembly according to claim 1, wherein the filter pack comprises woven sintered nickel-chromium-iron alloy fibers having an average porosity of between about 2 to about 15 μm.

3. A filter assembly according to claim 1, wherein the housing unit comprises an inlet housing coupled to an outlet housing.

4. A filter assembly according to claim 1, configured to operate having a fuel penalty of less than about 3%.

5. A filter assembly according to claim 1, having a soot loading capability of between about 0.5 g/l to about 4 g/l.

6. A filter assembly according to claim 1, further comprising at least one weld strap circumferentially disposed about the filter pack and configured to secure the filter pack to the inner core member.

7. A filter assembly according to claim 1, wherein the filter pack comprises at least 150 folds and has a surface area greater than about 7 $ft^2$.

8. A filter assembly according to claim 1 configured such that the diesel exhaust travels from the inlet port into the filtering chamber and passes inwardly through the cylindrical filter pack to an interior of the inner core member and exits through the outlet port.

9. A filter assembly according to claim 1, wherein the exterior layer has an exterior porosity and the interior layer has an interior porosity different than the exterior porosity.

10. A filter assembly according to claim 9, wherein an average exterior porosity is between about 7 to about 15 μm and an average interior porosity is between about 2 to about 7 μm.

11. A passive particulate filter assembly comprising:

a housing unit defining a filtering chamber having an inlet port and an outlet port;

a perforated cylindrical inner core member disposed in the filtering chamber;

a pleated cylindrical filter pack comprising a dual layer laminate woven sintered nickel-chromium-iron alloy fiber medium surrounding the inner core member and having first and second opposite ends, the innermost layer having an average porosity of between about 2 to about 7 μm and the outermost layer having an average porosity of between about 7 to about 15 μm;

an end cap coupled to the first end of the filter pack and configured to prevent exhaust flow there through; and a flanged end plate coupled to the second end of the filter pack and configured to secure the filter pack to the housing unit;

wherein the filter assembly is configured such that exhaust travels from the inlet port into the filtering chamber and passes inwardly through the dual layer filter pack to an interior of the inner core member and exits through the outlet port.

12. A filter assembly according to claim 11, configured to configured to operate having a fuel penalty of less than about 3%.

13. A filter assembly according to claim 11, wherein the filter pack comprises at least 150 folds and has a surface area greater than about 7 $ft^2$.

14. An exhaust gas filtering system for a diesel engine comprising:

a passive diesel particulate filter assembly including a housing unit defining a filtering chamber having a cylindrical inner core member surrounded by a dual layer laminate woven sintered nickel-chromium-iron alloy fiber medium, wherein the innermost layer of the nickel-chromium-iron alloy fiber medium has an average porosity of between about 2 to about 7 μm and the outermost layer of the nickel-chromium-iron alloy fiber medium has an average porosity of between about 7 to about 15 μm; and a secondary injection assembly coupled to the housing unit and configured to selectively heat the diesel exhaust to a temperature suitable for regeneration of the passive diesel particulate filter.

15. A system according to claim 14, wherein the filter assembly is configured such that the diesel exhaust travels into the filtering chamber and passes inwardly through the dual layer filter pack to an interior of the inner core member and exits through an outlet port.

16. A system according to claim 14, wherein the secondary injection assembly is configured to regenerate a loaded filter assembly with a maximum fuel penalty of about 3%.

* * * * *